United States Patent [19]

Reeves

[11] Patent Number: 4,817,957

[45] Date of Patent: Apr. 4, 1989

[54] VARIABLE MAZE BOARD GAME

[76] Inventor: Gregory L. Reeves, 1445 S. Gibbs, #B, Pomona, Calif. 91766

[21] Appl. No.: 101,414

[22] Filed: Sep. 28, 1987

[51] Int. Cl.[4] ..... A63F 3/00

[52] U.S. Cl. ..... 273/248; 273/281; 273/284

[58] Field of Search ..... 273/281, 284, 153 S, 273/153 R, 248

[56] References Cited

U.S. PATENT DOCUMENTS

| | | | |
|---|---|---|---|
| 729,522 | 6/1903 | Anderson | 273/153 S |
| 1,518,178 | 12/1924 | Chefko | 273/289 |
| 1,700,016 | 1/1929 | Belanger | 273/289 |

FOREIGN PATENT DOCUMENTS

| | | | |
|---|---|---|---|
| 2359407 | 6/1975 | Fed. Rep. of Germany | 273/153 R |

*Primary Examiner*—Richard C. Pinkham
*Assistant Examiner*—Benjamin Layno
*Attorney, Agent, or Firm*—Boniard I. Brown

[57] ABSTRACT

A game played on a playing board having a plurality of intersecting lateral and longitudinal grooves defining a grid of squares. A plurality of laterally and longitudinally oriented movable bars on the grid define a maze therewith. The movable bars are operatively connected to the grooves and respectively move laterally and longitudinally along the grooves. The movement of the bars changes the maze paths. Each bar has a width of one square and a length of three squares of the grid. The game apparatus also includes a plurality of playing pieces, objects for indicating random numbers of permissible movements of the playing pieces and the bars, and a surrounding frame to definitize the playing area and to retain the bars. Normally, an even number of players, such as two, attempt to move their playing pieces from opposite ends across the grid, end to end, the randomizing objects indicating the permissible number of squares across which the playing pieces can be moved and which laterally and/or longitudinally oriented bars can be shifted on the grid. The bars preferably include mechanical interfaces with the grooves of the grid which assure a stable position exactly covering a line of three adjacent squares.

14 Claims, 2 Drawing Sheets

VARIABLE MAZE BOARD GAME

BACKGROUND OF THE INVENTION

Many different maze-type board games are known. Simple maze games where the playing board presents a fixed maze are shown by the classic Parcheesi game and in U.S. Pat. No. 4,465,283 to PILETTE, et al; West German Pat. No. 801,435 to SCHULLE; French Pat. No. 1,042,543 to GUILBERT and British Pat. No. 2,103,941 to CAMPBELL. Some maze games, such as shown in U.S. Pat. No. 3,712,617 to OHLSCHLAGER and U.S. Pat. No. 3,025,063 to MAGEE, have maze walls which are movable before or after the game is started. Some known maze games include gates which move when playing pieces are moved therethrough in a not easily predeterminable manner, such as shown in U.S. Pat. No. 4,465,280 to DIMITRIU. Other games have portions of the maze which are movable during the course of the game to make it more unpredictable. Such are shown in U.S. Pat. No. 3,731,934 to SHOPTAUGH and U.S. Pat. No. 4,453,718 to CHRISTOPERSON. In CHRISTOPERSON's game, the changing of the maze is accomplished by pivoting four auxiliary game boards about a central game board whereas in SHOPTAUGH, two pairs of identical but oppositely oriented slider bars are moved laterally across a game board while playing pieces are moved longitudinally thereon.

SUMMARY OF THE INVENTION

In the present invention a large playing board grid is provided. A suitable grid is 15 squares wide and 21 squares long although other numbers of squares, preferably divisible by three, can be provided. The grid is defined on the playing board by longitudinal and lateral grooves in which are attached a plurality of slidable bars sized to cover the three squares of the grid in a row. Preferably one third of the grid surface, not counting Start and Finish positions, are covered with these bars. Lateral bars have one indicia, longitudinal bars have another and a lateral center bar, located in the middle of the grid surface, has third indicia. The bars are retained to the playing surface by suitable legs, and side and end trim strips which block the ends of the crosswise slots defining the grid. It is preferable that the bars have interlock devices which mesh with the grid to assure that the bars remain in stable positions covering three squares of the grid.

An equal number of playing pieces are provided to each player with the object of the game being for a player to move his or her playing pieces from one end of the board to the other. Players accomplish this by operating randomizing elements which indicate the permissible number of squares over which a playing piece may be moved, and the number, type, and amount of movement that the player can move bars during the player's turn. A player may move the bars to assist in the movement of his pieces and/or impede the movement of other player's pieces, normally being moved in the opposite end to end direction. Safety squares are provided on the grid to indicate areas where a playing piece may not be landed upon by an opponent's playing piece for removal back to a Start position.

Therefore it is an object of the present invention to provide a game which is intellectually challenging.

Another object is to provide a new and novel game apparatus whose playing surface, although seemingly complex, is easily constructed from economical materials so that it can be provided to the consumer at reasonable cost.

Another object is to provide a new type of maze game whose maze paths change both laterally and longitudinally during the game to interject the requirement for skill in addition to luck into the game.

These and other objects and advantages of the present invention will become apparent to those skilled in the art after considering the following detailed Specification together with the accompanying drawings wherein:

DETAILED DESCRIPTION OF THE SHOWN EMBODIMENTS

Figure 1:
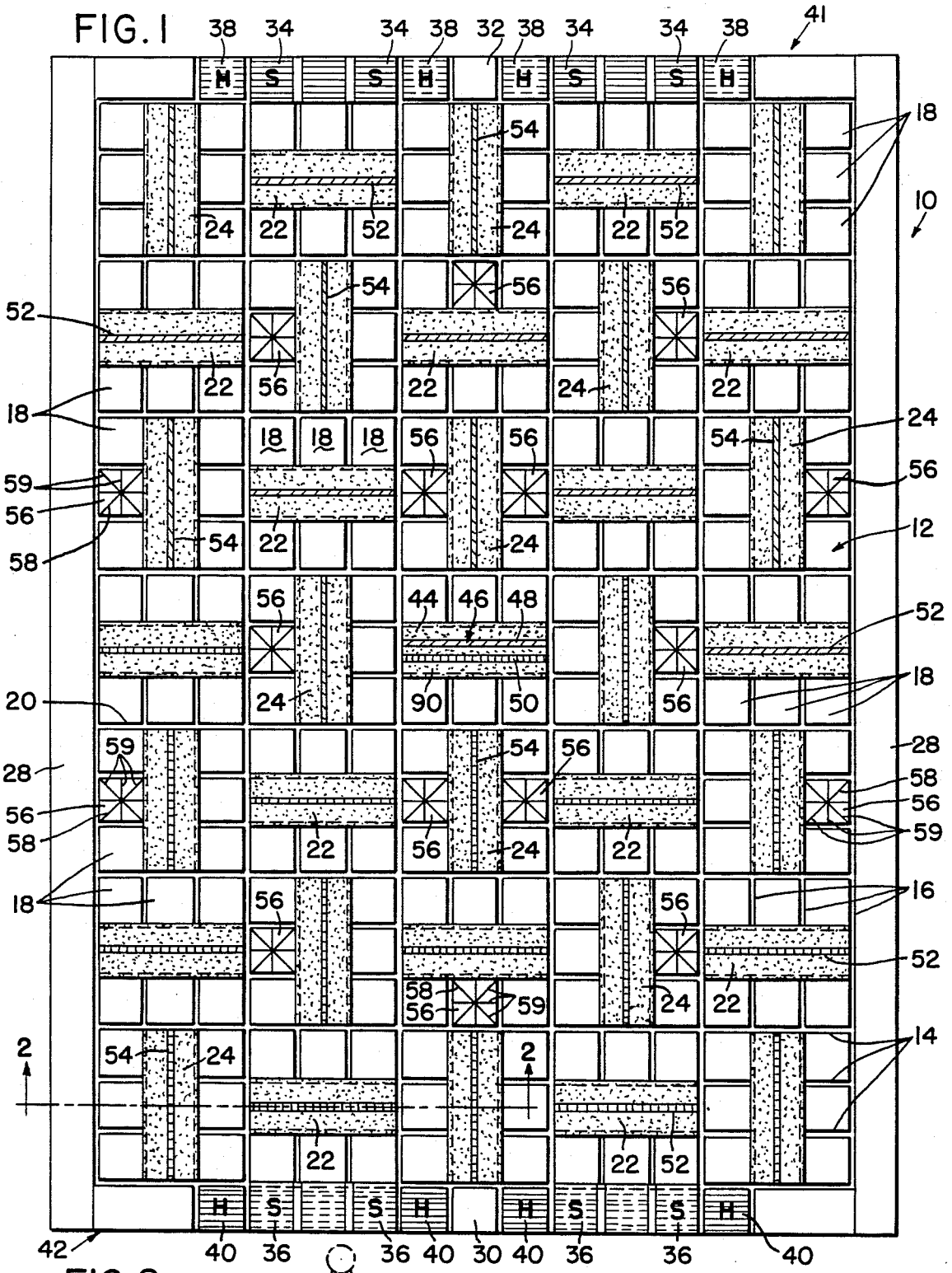
FIG. 1 is top elevational view of the game board of the present invention having bars installed thereon in their suggested initial positions.
Figure 2:
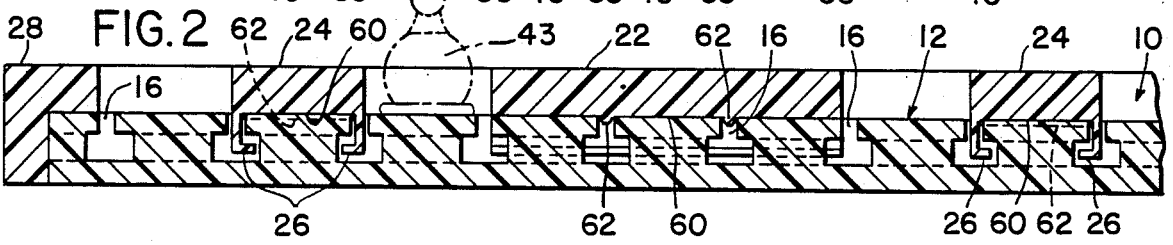
FIG. 2 is an enlarged cross-sectional view taken at line 2—2 in FIG. 1.
Figure 3:
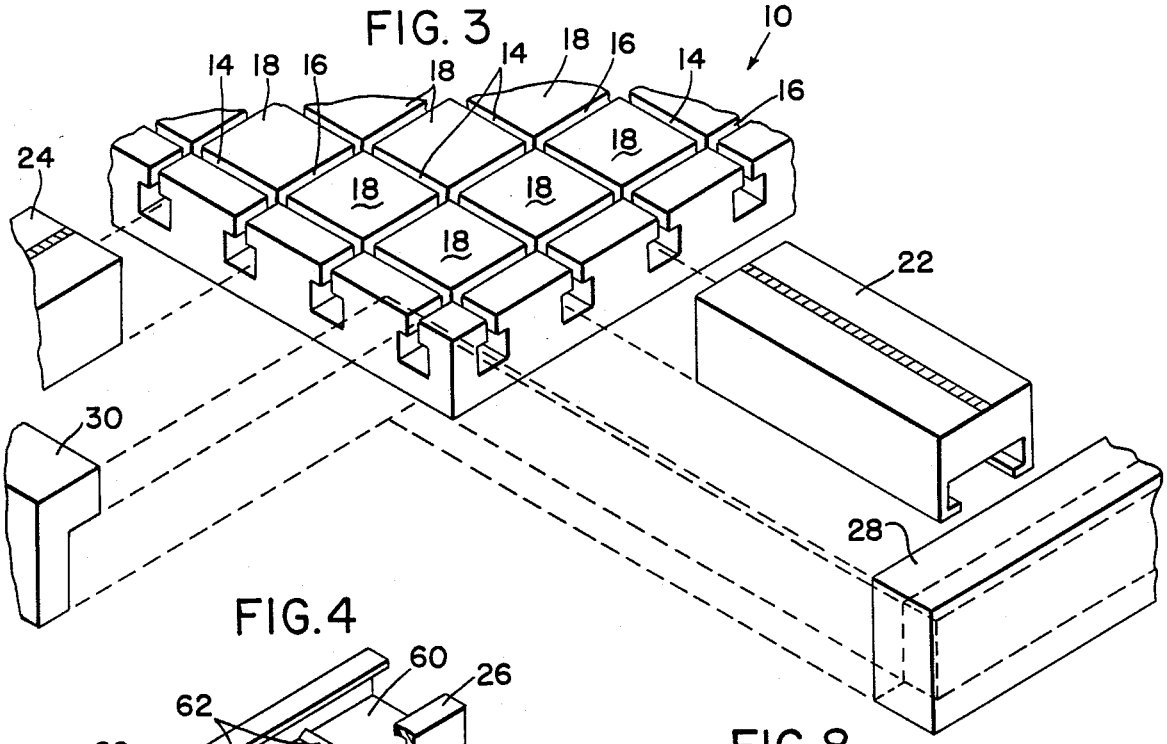
FIG. 3 is an exploded perspective view of the right hand corner of FIG. 1.

Referring to the drawings more particularly by reference numbers, number 10 in FIG. 1 refers to a game board constructed according to the present invention. As shown in FIGS. 2 and 3, the game board 10 includes a flat playing surface 12 cut by a plurality of lateral and longitudinal grooves 14 and 16 to define a plurality of squares 18 of a grid 20. The grooves 14 and 16 preferably have an inverted T-shape so that lateral maze bars 22 and longitudinal maze bars 24, each having L-shaped feet 26, can be slid onto the grooves 14 and 16 and be retained thereby when side trim strips 28 and end trim strips 30 and 32 are attached to the game board 10.

The end trim strips 30 and 32 each have extensions of the grid indicated thereon to provide Start positions 34 and 36, shown marked by an "S" and Finish or Home positions, 38 and 40, shown marked by an "H". Usually, the Start and Finish positions such as 34 and 40, or 36 and 38 at opposite ends 41 and 42 of the game board 10 are of a color matching the color of the playing pieces 43 of each player. For example, Start position 34 and finish position 40 might be Blue while Start position 36 and Finish position 38 might be Grey when both Blue and Grey playing pieces 43 are being used.

As shown in FIG. 1, there is one lateral maze bar 44 in the center of the game board 10 which has indicia 46 in the form of two colored bars 48 and 50 which differs from the indicia 52 on the other lateral maze bars 22 and the indicia 54 on the longitudinal maze bars 24. The indicia 46 indicates that the bar 44 is special and may be slid along the lateral grooves 22 on the game board 10 only under certain specific instances to be described later. The game board 10 also has a plurality of safety zone squares 56 having indicia 58 for indicating their presence which may be the lines 59, as shown, different colors or other suitable means. When a playing piece 43 is on a safety zone square 56 it cannot be sent back to a Start position 34 or 36 by the opposing player.

Figure 4:
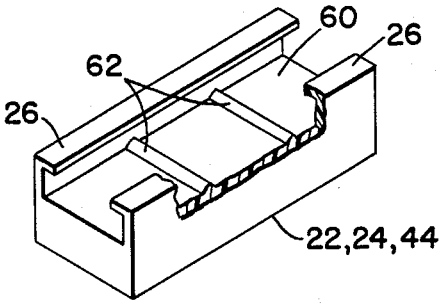
FIG. 4 is an enlarged, partial cross-sectional view of the underside of a maze bar.

As shown in FIG. 4, the maze bars 22, 24 and 44 include an undersurface 60 which has suitable wedge shaped ribs 62 or other mechanical means to interlock with the lateral and longitudinal grooves 14 and 16 to assure that the maze bars 22, 24 and 44 remain as positioned when moved to cover three complete squares 18. A single rib 62 would also work.

Figure 5:
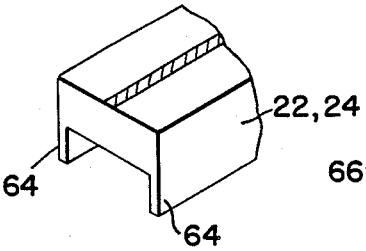
FIG. 5 is a partial perspective view of a maze bar modified for easy removal from the game board.
Figure 6:
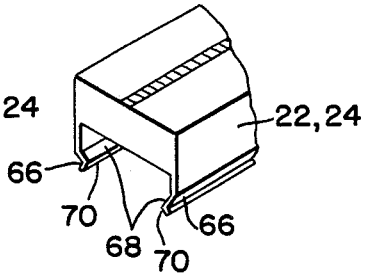
FIG. 6 is another maze bar modified for snap on and off removal from the game board.

As shown in FIG. 5, the bars 22, 24 and 44 may be constructed with straight legs 64 if it is desired to have the bars easily removable from the game board 10. As shown in FIG. 6, the bars 22, 24, and 44 also may be constructed with snap-on legs 66, each including a flexible portion 68 and a retaining groove portion 70. Legs 64 or 66 are provided when it is desirable to be able to remove the bars 22, 24 and 44 which are positioned on the game board 10 during normal play.

Figure 8:
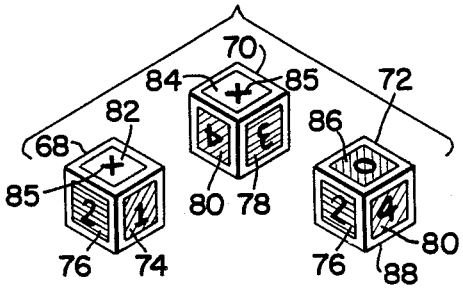
FIG. 8 is a perspective view of dice suitable as randomizing objects for the present game.
Figure 7:
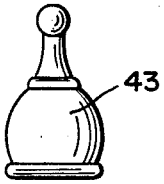
FIG. 7 is side elevational view of a typical game piece or man used in the present game.

When play is to be commenced, the bars 22, 24 and 44 are positioned, as shown in FIG. 1, with playing pieces 43, such as shown in FIG. 7, being positioned on each of the Start positions 34 and 36. With the game board 10 as shown, it is preferable to have four playing pieces 43 for each person with the playing pieces 43 of each person being distinguishable either in shape, color, surface roughness or other characteristic. Randomizing elements, such as the dice, 68, 70 and 72 shown in FIG. 8, then are brought into play. The dice 68 and 70 are identical having numbers from 1 through 4 on each of their sides 74, 76, 78 and 80 while their tops 82 and bottoms 84 have starting indicia 85, shown as X's. The sides 74 and 80 preferably have an additional indicia, such as a distinctive red color. When so colored, sides 76 and 78 may have a distinctive green color while the tops 82 and bottoms 84 have a third distinctive color. The first two colors preferably correspond with the colors of the indicia 52 and 54 on the bars 22 and 24 and the indicia 46 on the bar 44. The third die 72 has sides 74, 76, 78 and 80 identical to the sides on dice 68 and 70. However, its top and bottom 86 and 88 are marked with zeros, the top having the same color as sides 74 and 80 and the bottom 88 having the same color as sides 76 and 78.

Once the board has been set up by sliding the maze bars 24, 26 and 44 so that they are exactly one square apart from each other, and the playing pieces 43 are properly positioned on the Start positions 34 and 36, each player rolls all three of the dice 68, 70 and 72 with the player rolling the highest total going first. When playing, each player completes each phase of a turn in the exact order of:

1. bringing the playing pieces 43 out of the Start positions and onto the game board 10;
2. moving the playing pieces 43; and
3. sliding the maze bars 22, 24 and 44.

To enter onto the maze of the game board 10, the player must roll an "X" on a dice 68 or 70. The player can bring out one playing piece 43 for each "X" that is rolled and the player must enter onto the grid 20 whenever possible. Entry begins on the square 18 directly in front of the playing piece 43 the player intends to bring onto the grid 20. However, a player may not enter this square 18 if it is already occupied by one of the player's own playing pieces 43. To exit the grid 20 once the maze has been traversed, the player must roll the exact number on a die 68, 70, or 72 to move the playing piece 43 onto a Finish square 38 or 40. Two playing pieces 43 cannot occupy the same Finish square 38 or 40.

As has been explained previously, the dice 68, 70 and 72 are numbered one through four. These numbers represent the number of squares the player may move his playing pieces 43. For example, if a player rolls a 4, 3, 2, the player may move one playing piece 43 nine squares 18, or one playing piece 43 four squares 18 and one playing piece 43 five squares 18, or one playing piece 43 four squares 18, one playing piece 43 three squares 18 and one playing piece 43 two squares 18. The playing pieces 43 may be moved horizontally, vertically, diagonally, forward or backward, but each must be moved the full count of a die 68, 70', or 72 in one direction. During a turn, a player may not pass over the same square 18 twice with one playing piece 43 the player may not land on the same square 18 the playing piece 43 started from, nor may any playing piece 43 be moved over any maze bar 22, 24 or 44 at any time. However, playing pieces 43 may pass over opponent's playing pieces 43 as well as the player's other playing pieces 43 at any time. If a player cannot or chooses not to take the full count of all three of the dice 68, 70 and 72, then the player's turn ends and the player may not move any maze bars 22, 24 or 44. Maze bar movement occurs only after a player has moved the full count of all dice 68, 70 and 72. If a player rolls triplets, and can and does take the full count of all three dice, then the player may roll the dice 68, 70 and 72 again for as many times as triplets are rolled.

As stated above, the sides of the dice 68, 70 and 72 preferably are color coded to the indicia 52, 54, and 46 on the maze bars 22, 24, and 44. A typical example would be red indicia 54 on the longitudinal bars 24, green indicia 52 on the lateral bars 22, and both red and green indicia 46 on the maze bar 44. The dice 68, 70 and 72 therefore control the movement of the maze bars 22, 24, and 44. For instance, if the player rolls two red sides and one green side on the dice 68, 70 and 72, then the player can move two longitudinal bars 24 up or down one square 18 and one lateral bar 22 across one square 18, or one longitudinal bar 24 up or down two squares 18 and one lateral bar 22 across one square 18. The initial positioning of the bars 22 and 24 prevents any to be moved more than two squares 18 during a turn. In order to move the red and green lateral bar 44 in the center 90 of the grid 20 one square 18 over, a player must roll at least one red side and one green side on the dice 68, 70 and 72. A player may move all, part, or none of the allowed maze bar movements. Therefore, it is never possible to move the maze bar 44 more than one square 18 or move more than three maze bars 22 and 24 during a single turn.

Capture of playing pieces 43 occurs when a player lands on a square 18, excluding the safe squares 56 previously mentioned, occupied by an opponent's playing piece 43. When a playing piece 43 is captured, the player may send the opponent's playing piece 43 back to any of its unoccupied Start positions 34 or 36. Although a playing piece 43 may not be captured while on a safe square 56, a player may leave a safe square 56 to capture an opponent's playing piece 43. When a player, during the course of a turn, captures one or more of the opponents playing pieces 43, that player may roll the dice again for each of the playing pieces captured but the player can only move the count shown and cannot move the bars 44, 48, or 50 until after the last roll of the turn. Once a player has entered the maze he may not return any of his playing pieces 43 to a Start position unless they have been captured and sent back by the opposition. Also, a player may not move his playing pieces 43 onto the Finish positions 38 or 40 of the opposition or to capture a playing piece 43 thereon. However, a player may leave his Finish position to capture another playing piece 43 or to be able take the count on the dice 68, 70 and 72 to allow maze bar movement. At no time may two playing pieces 43 occupy the same square 18 except during the process of capturing which means that occupied safe squares 56 cannot be used to finish a move. The game is won when one player gets all four of his playing pieces 43 to the opposite side of the grid 20 and onto the Finish positions 38 or 40.

Therefore there has been shown and described a novel game and apparatus which fulfills all the objects and advantages sought therefore. Many changes, modifications, variations and other uses and applications of the subject invention will, however, become apparent to those skilled in the art after considering this Specification together with the accompanying drawings. All such changes, modifications, variations and other uses and applications which do not depart from the spirit and scope of the invention are deemed to be covered by the invention which is limited only by the claims which follow:

What is claimed is:

1. A game apparatus including:

a body having:

a surface having a center, a first end, a second opposite end, first and second sides, a first plurality of generally parallel lines oriented in a first direction from said first end to said second end, and a second plurality of generally parallel lines oriented in a second direction generally at a right angle to said first direction and extending from said first side to said second side, said first and second pluralities of generally parallel lines forming a grid and defining areas on said grid, a first plurality of obstructions positioned on said surface and operatively connected to said body for movement along said first plurality of generally parallel lines, said first plurality of obstructions including first indicia thereon, a second plurality of obstructions positioned on said surface and operatively connected to said body for movement along said second plurality of generally parallel lines, said second plurality of obstructions including second indicia thereon, and a third obstruction positioned on said surface and operatively connected to said body for movement along two of said second plurality of generally parallel lines over said center of said surface, said third obstruction having:

third indicia thereon.

2. The game apparatus as defined in claim 1 wherein said third indicia contains both said first and second indicia.

3. The game apparatus as defined in claim 2 wherein said first, second, and third obstructions are each sized and positioned to cover three of said areas of said grid.

4. The game apparatus as defined in claim 1 wherein said first and second obstructions are each sized and positioned to cover three of said areas of said grid.

5. The game apparatus as defined in claim 4 wherein said first and second pluralities of generally parallel lines are formed by inverted T shaped channels formed in said body at right angles to each other, said first and second obstructions each having:

a bar body portion having:

top and bottom surfaces;

first and second bar sides;

first and second bar ends; and a length from said first bar end to said second bar end about three times its width from said first bar side to said second bar side;

a first leg connected to said bottom surface extending from said first bar side adapted for engagement in one of said inverted T shaped channels; and a second leg connected to said bottom surface extending from said second bar side adapted for engagement in one of said inverted T shaped channels.

6. The game apparatus as defined in claim 5 wherein said first and second legs are L shaped in cross-section and said bottom surfaces include:

means for engagement with said inverted T shaped channels positioned to establish stable positioning of said obstructions over three defined areas.

7. The game apparatus as defined in claim 5 wherein said bar body portions of said first and second obstructions have a surface area of about three of said defined areas of said grid, said first and second obstructions covering one third of said defined areas.

8. The game apparatus as defined in claim 7 further including:

at least one first playing piece for positioning and moving on said surface having a first distinguishing characteristic;

at least one second playing piece for positioning and moving on said surface having a second distinguishing characteristic;

at least one randomizing element to indicate permissible movement of said playing pieces and said obstructions on said surface; and a marking on selected defined areas to indicate safe zones.

9. The game apparatus as defined in claim 8 further including:

first and second side members connected to said body at said first and second sides to restrict movement of said second obstructions to said surface; and first and second end members connected to said body at said first and second ends to restrict movement of said first obstructions to said surface, said first and second end members having starting and finishing positions for said playing pieces thereon.

10. A game apparatus including:

a body having:

a surface, a first plurality of generally parallel lines oriented in a first direction along said surface, and a second plurality of generally parallel lines oriented in a second direction generally at a right angle to said first direction along said surface, said first and second pluralities of generally parallel lines forming a grid and defining areas on said grid, a first plurality of obstructions positioned on said surface and operatively connected to said body for movement along said first plurality of generally parallel lines, a second plurality of obstructions positioned on said surface and operatively connected to said body for movement along said second plurality of generally parallel lines, said first and second obstructions each having:

a bar body portion having:

top and bottom surfaces including means for engagement with said lines positioned to establish stable positioning of said obstructions over three defined areas, first and second bar sides, first and second bar ends, and a length from said first bar end to said second bar end about three times its width from said first bar side to said second bar side, a first leg connected to said bottom surface extending from said first bar side adapted for engagement in one of said lines, and a second leg connected to said bottom surface extending from said second bar side adapted for engagement in one of said lines.

11. The game apparatus as defined in claim 10 wherein said bar body portions of said first and second obstructions have a surface area of about three of said defined areas of said grid, said first and second obstructions covering one third of said defined areas.

12. The game apparatus as defined in claim 11 wherein said first and second pluralities of generally parallel lines are formed by inverted T shaped channels formed in said body at right angles to each other, and wherein said first and second legs are L shaped in cross-section to engage in said inverted T shaped channels.

13. The game apparatus as defined in claim 11 wherein said first and second pluralities of generally parallel lines are formed by inverted T shaped channels formed in said body at right angles to each other, and wherein said first and second legs each include a central flexible portion and a V shaped end portion to engage in said inverted T shaped channels.

14. A game in which at least two players attempt to be the first to move playing pieces across a maze from opposite directions including:

a body having:

a surface, a first plurality of generally parallel grooves oriented in a first direction along said surface, and a second plurality of generally parallel grooves oriented in a second direction generally at a right angle to said first direction along said surface, said first and second pluralities of generally parallel grooves forming a grid and defining areas on said grid, a first plurality of obstructions positioned on said surface and operatively connected to said body for movement along said first plurality of generally parallel grooves to form the maze, a second plurality of obstructions positioned on said surface and operatively connected to said body for movement along said second plurality of generally parallel grooves to form the maze, said first and second obstructions each having:

a bar body portion having:

top and bottom surface, each of said bottom surfaces including at least one downwardly extending rib for engagement with said grooves positioned to establish stable positioning of said obstruction over three defined areas, first and second bar sides, first and second bar ends, and a length from said first bar end to said second bar about three times its width from said first bar side to said second bar side, a first leg connected to said bottom surface extending from said first bar side adapted for engagement in one of said grooves, and a second leg connected to said bottom surface extending from said second bar adapted for engagement in one of said grooves.

* * * * *